US007131560B2

(12) United States Patent
Hammond

(10) Patent No.: US 7,131,560 B2
(45) Date of Patent: Nov. 7, 2006

(54) PORTABLE BEER KEG TAP AND DISPENSER

(76) Inventor: Jerry Graham Hammond, 3426 Carriage House, Richmond, TX (US) 77469

( * ) Notice: Subject to any disclaimer, the term of this patent is extended or adjusted under 35 U.S.C. 154(b) by 154 days.

(21) Appl. No.: 10/891,951

(22) Filed: Jul. 15, 2004

(65) Prior Publication Data

US 2006/0011664 A1 Jan. 19, 2006

(51) Int. Cl.
*B65D 83/44* (2006.01)

(52) U.S. Cl. ..... 222/399; 222/400.7

(58) Field of Classification Search ..... 222/399, 222/400.7, 400.8

See application file for complete search history.

(56) References Cited

U.S. PATENT DOCUMENTS 3,129,730 A * 4/1964 Simon ..... 141/286
3,141,690 A * 7/1964 Greenfield ..... 403/374.4
3,933,282 A * 1/1976 Stevens, Jr. ..... 222/400.7
4,940,212 A * 7/1990 Burton ..... 261/64.1
5,529,220 A * 6/1996 Credle et al. ..... 222/175
5,730,323 A * 3/1998 Osborne ..... 222/55
6,237,809 B1 * 5/2001 Kawai et al. ..... 222/95
2003/0024952 A1 * 2/2003 Mackenzie et al. ..... 222/399

* cited by examiner

*Primary Examiner*—Joseph A. Kaufman
(74) *Attorney, Agent, or Firm*—Arthur M. Dula

(57) ABSTRACT

A lightweight beer dispensing system comprising a small carbon dioxide pressure bottle attached directly to an adjustable pressure regulator that can be set to avoid excess foaming is attached directly to a keg tap having a delivery faucet. The invention taps a full size beer keg and uses $CO_2$ to keep the beer fresh thus avoiding the problem of introducing oxygen into the beer keg.

3 Claims, 2 Drawing Sheets

PORTABLE BEER KEG TAP AND DISPENSER

FIELD

The present invention relates generally to an apparatus used to tap beer kegs and dispense beer. More specifically the present invention relates to a lightweight portable beer keg tap and beer dispenser operated by $CO_2$ gas from a compressed gas cylinder.

BACKGROUND OF THE INVENTION

We can trace the beginning of beer drinking far back beyond the dawn of recorded time. Most likely, a crude form of beer was discovered by accident when someone mixed barley with water and then let it sit long enough for stray yeast cells to settle, triggering fermentation. The Babylonians, Assyrians, Egyptians, Hebrews, Africans, Chinese, Incas, Teutons, Saxons and various wandering tribes all discovered beer by various independent means. The dispensing system used by these early brewers were amphora, mugs and the early equivalent of straws, which were used to sip the liquid beer while avoiding the brewer's residue.

From the middle ages, when the use of hops made beer clear, until the 1890's, beer was stored in and dispensed from wooden barrels through simple valves and delivered to the drinker mug or glass by gravity flow. From the 1950's to the present most draft beer has been shipped in and dispensed from kegs that are cylindrical, made of stainless steel or aluminum and contain an extractor tube.

To dispense the beer from the keg a pressurizing gas, air or $CO_2$, is forced into the keg through a beer keg tap. The liquid beer is forced out through the extractor tube, flexible hoses and a delivery faucet. Air is very undesirable as a pressurizing gas because the oxygen in air makes beer quickly go stale or sour. Air can be used when the entire keg is to be drunk quickly. Air cannot be used as a pressurizing gas if the keg must be stored and the beer consumed over a period of time.

There are two general types of beer dispensing systems taught by the prior art. One is a commercial system that uses heavy pressure bottles of compressed carbon dioxide gas operating through regulators and pressure lines to pressurize one or more kegs. The other is a consumer system usually used at a party or picnic that uses an air pump, which may be a hand powered or electrically operated compressor, to pressurize the keg. This is therefore commonly known as a picnic pump system.

Advantages of the commercial beer dispensing systems include the use of $CO_2$ dispensing systems that prevent air from coming in contact with the keg beer and thus allowing the keg beer to stay fresh for a longer period of time than when air is used as a pressurizing gas. Another advantage of a commercial beer dispensing system is the ability to control the pressure of the gas supplied to the keg through the use of adjustable regulators and pressure gauges. This feature is a marked advantage over a picnic pump system as it allows the pressure to be finely tuned to the individual type of beer or the specific temperature of the keg to prevent excessive foaming of the dispensed beer as is often encountered in the picnic pump systems.

Examples of commercial beer dispensing systems may be found in most bars and restaurants. This equipment is cumbersome and industrial. Their 'rat's nest' of tubing is a common feature behind bars. These commercial $CO_2$ dispensing systems weigh hundreds of pounds and can operate dozens of beer keg taps and draft beer dispensers. This equipment is completely unsuitable for use at picnics, parties or for the large and growing number of drinkers who wish to keep a keg of beer at home in their refrigerator so they can have draft beer at home on demand.

Picnic pumps such as the one taught by U.S. Pat. No. 4,711,377, issued to Brown on Dec. 8, 1987 use a hand-operated air pump. Such pumps are common and exist in hundreds of variations. These pumps are small and lightweight, but they pressurize the beer keg with air, which makes them unsuitable for use with a home keg because contact with the oxygen in air quickly ruins the beer.

U.S. Pat. No. 5,785,211 teaches a portable electrically powered keg-tapping device for use with regular beer kegs. The electrical compressor is a good replacement for a hand pump, but it does not solve the problem of introducing air into a keg that must be stored and used over a period of time.

An advantageous beer pumping system would combine the beer preservation and adjustable pressurization available with commercial type systems with the low profile and portability of a picnic pump system. Portable beer dispensing systems, such as the one taught by U.S. Pat. No. 5,199,609, issued to Ash on Apr. 6, 1993, teach the use of a $CO_2$ bottle packaged in a backpack and connected by pressure tubes to a container of beer. This type of dispenser, and there are many examples in the prior art, is useful for dispensing beer at sporting events, but uses a special small beer tank and thus cannot be of any use to home beer keg owners.

Another portable beer dispensing system, U.S. Pat. No. 2,571,433, issued to Fine et al. on Oct. 16, 1951, teaches the use of a small pressurized cylinder and a regulator permanently attached to a specialized beer container. However, the specialized beer container is not commercially available. Furthermore the pressurization system is permanently attached to the non commercially available specialized beer container. Additionally, the presence of a cover over the pressurization system does not facilitate precision pressure adjustments for individual types of beer or specific keg temperatures to prevent unwanted foaming. A more useful device will combine all the advantages of a commercial beer pumping system, such as $CO_2$ pressurization to maintain beer freshness and easy adjustability of the $CO_2$ pressure to prevent foaming, with the low profile and portability of a picnic pump system. Interestingly, no devices that incorporate all the advantages of a commercial beer pumping system with the low profile and portability of a picnic beer pumping system currently exist.

This combination would allow for a simple home draft beer system by placing a small, easily adjustable $CO_2$ pressurized beer pump on any commercially available beer keg. The keg with the beer pump could then be placed in any conventional refrigerator for to keep the beer at a constant drinkable temperature. Currently, home kegs may be kept in refrigerated one keg systems, such as the Beer Baron® sold by Ajex USA, Inc. of Commerce City, Colo., but such "home" draft beer systems are huge, weigh several hundred pounds and are very expensive.

U.S. Pat. No. 4,180,189, issued to Zurit et al. Dec. 25, 1979 teaches the use of a standard keg tap using a conventional bayonet type of connection to attach the tap to the keg. In addition U.S. Pat. No. 4,180,189 also teaches the use of a pressure inlet to pressurize the beer keg in combination with a Thomas valve designed to prevent back pressure or beer from flowing out of the pressure inlet into the pressure producing source. However, the incorporation of a Thomas valve to help prevent back pressure or beer into the pressure producing has not been rigidly attached to a regulator and a rigidly attached gas canister designed for kegs to be stored in a home refrigerator. The Thomas valve in U.S. Pat. No. 4,180,198 would be designed to prevent back pressure or beer from flowing into a flexible tube used to deliver pressure to the tap, thereby preventing damage to the flexible tube. A desirable invention, in combining all the advantages of a commercial beer pumping system with the low profile and portability of a picnic beer pumping system would have a Thomas valve directly attached to a check valve and furthermore to an easily adjustable pressure regulator and finally attached to a pressurized $CO_2$ canister.

It is applicant's belief that none of the above prior art systems have received commercial recognition because they either are too expensive to construct, or are not reliable. None of the above prior art systems solve the problems facing the home keg owner who wishes to tap the keg and still keep the beer fresh over an extended period.

SUMMARY OF THE INVENTION AND ADVANTAGES

The invention is a beer dispensing system comprising a beer tap connected directly to an adjustable pressure regulator and a small $CO_2$ pressure bottle. The present invention combines the advantage of the commercial $CO_2$ beer dispensing system of operating with a full sized beer keg and keeping the beer fresh over a long period with the advantages of the small, lightweight, simple and convenient air operated party pump.

Yet another advantage of the present invention is that it provides a lightweight and small $CO_2$ operated beer-dispensing system that does not require the use of cumbersome hoses and pressure tubes.

Another advantage of the present invention is that it provides a beer dispensing system that will operate with a standard keg in a regular home refrigerator.

Yet a further advantage of the present invention is that it provides a $CO_2$ powered beer dispensing system that is small, lightweight, inexpensive and reliable.

Another advantage of the present invention is that it provides for precision adjustability of the pressure regulator, allowing the user to adjust the pressure of the beer tap for each individual type of beer or specific temperature of the keg, thus preventing the uncontrolled foaming that is often encountered with the picnic pump systems.

DESCRIPTION OF THE PREFERRED EMBODIMENT

Figure 1:
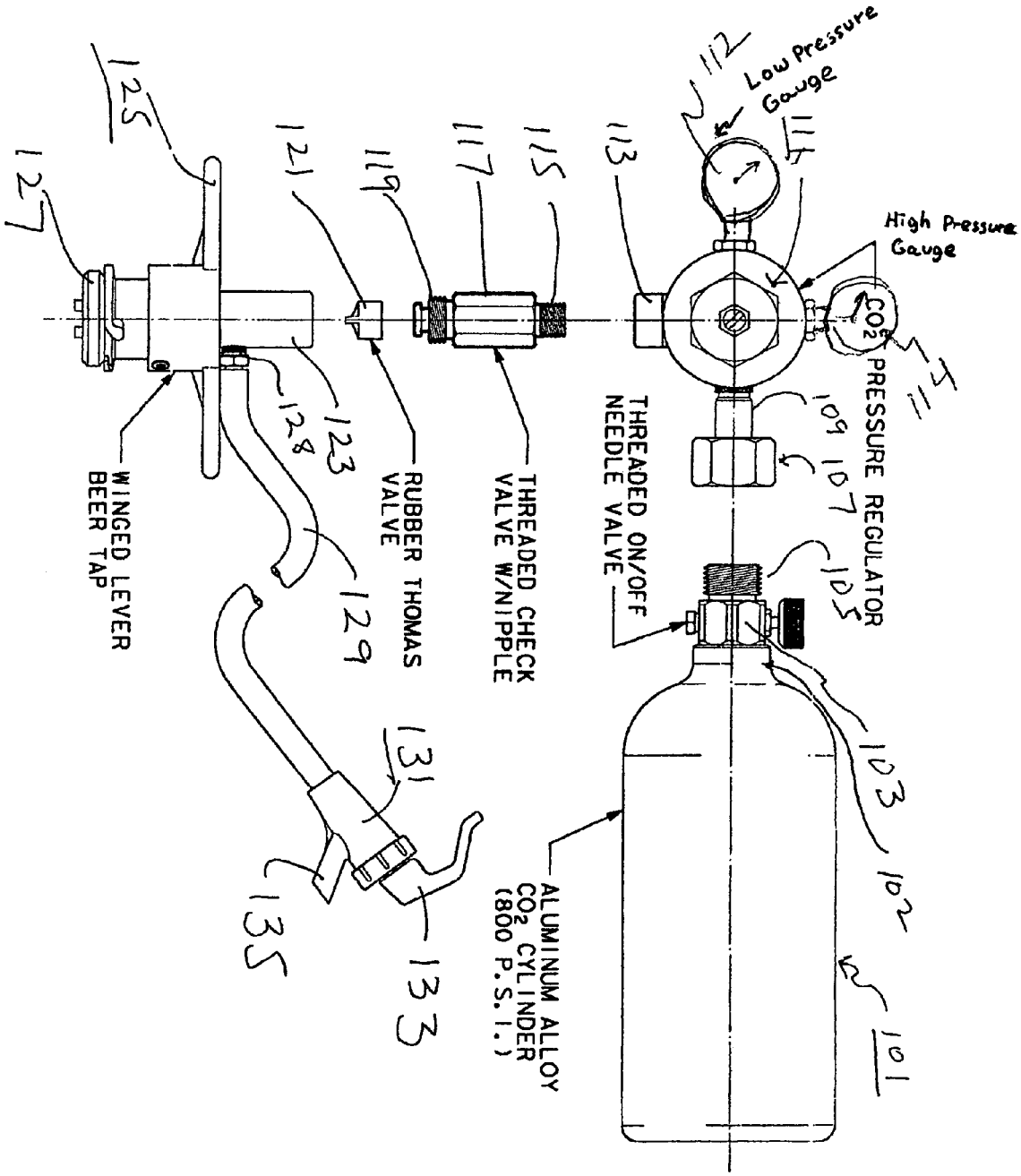
FIG. 1 shows the major components of the portable beer delivery system of the present invention with the individual parts separated for clarity.

FIG. 1 shows the components of the present invention and how they fit together. The components are shown separated for clarity.

In FIG. 1, aluminum alloy $CO_2$ cylinder 101 is a 16-ounce capacity 800 p.s.i. cylinder that is commercially used to power paint ball guns. It is available from Catalina Cylinders of Trumann, Ariz. They are inexpensive and safe.

Structurally, outlet 102 of cylinder 101 is attached to and in fluid communication with the inlet of needle valve 103, which is commercial low-pressure needle valve. Valve 103 has a threaded outlet 105 that is connected to and in fluid communication with the threaded inlet 107 of pressure regulator 111 by means of pressure regulator inlet pipe 109. Pressure regulator 111 may be any commercial pressure regulator capable of accepting an input pressure of 800 PSI and producing an easily adjustable variable output pressure of from zero to 50 PSI. One example is the model 03G07-222 forged brass regulator sold by the Foxx Equipment Company of Kansas City, MO. ("Foxx"). Regulator 111 is equipped with two pressure gauges, a low pressure gauge 112, designed to measure the pressure within the keg, and a high pressure gauge 114, designed to measure the pressure of the gas cylinder. Regulator 111 is also designed so that the pressure in the keg and the corresponding readout of the low pressure gauge 112 may be varied for each individual type of beer. This is accomplished by simply turning an adjustment device on the regulator 111 to the desired keg pressure. Regulator 111 also has its outlet 113 in threaded connection and fluid communication with inlet 115 of check valve with nipple 117. Check valve 117 may be a model 03G07-232 brass check valve sold by Foxx. The outlet nipple 119 of check valve 117 mates in fluid communication with rubber Thomas valve 121 and is threadingly attached to and in fluid communication with pressurization inlet 123 of beer keg tap 125. Beer keg tap 125 may be a universal twist style Sanke Tap® model number 07S07-102 available from Foxx. Beer tap 125 has a standard beer keg tap pressure fitting 127 that is adapted to operable engage a standard beer keg, not shown. Beer tap 125 also has a beer outlet 128. Beer outlet 128 is connected to and in fluid communication with flexible beer hose 129 and beer delivery faucet 131. Beer dispensing faucet 131 is attached at its inlet to and in fluid communication with beer hose 129. Beer dispensing faucet 131 is a standard hand-dispensing faucet having a hand-operating lever 133 and an outlet spout 135 for the delivery of the beer to a cup or glass, not shown. Faucet 131 may be a model 18A03-102 sold by Foxx.

Functionally, the high pressure $CO_2$ gas in cylinder 101 passes through needle valve 103 and into pressure regulator 111 where it is reduced in pressure from 800 PSI to about 20 PSI. The low pressure $CO_2$ then passes out of regulator 111, through check valve 117, Thomas valve 121 and beer tap 125 into the beer keg, which it pressurizes in a well-known manner. Beer from the keg flows out through beer tap outlet 128, through flex tube 129 to faucet 131 where it is dispensed to the drinker.

The entire invention including the $CO_2$ weighs less than six pounds and can be used to tap beer from any standard keg.

Figure 2:
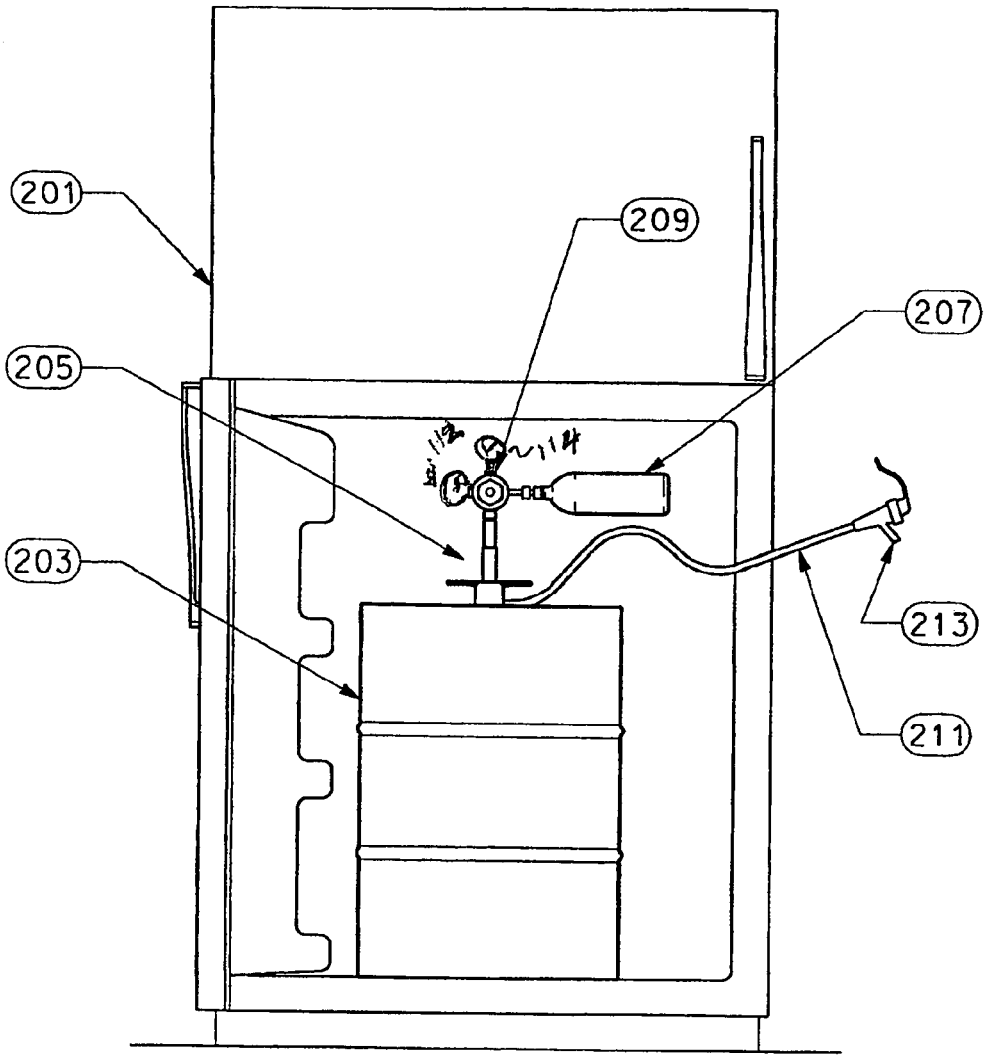
FIG. 2 shows the present invention mounted on a beer keg that is stored in a home refrigerator.

FIG. 2 shows the present invention used as a tap for a beer keg in an ordinary kitchen refrigerator. In FIG. 2, refrigerator 201 contains a beer keg 203. The portable beer keg tap and dispenser of present invention 205 is shown tapped into the keg. $CO_2$ tank 207 is attached to valve and regulator and tap assembly 209, which is attached to keg 203. Flex line 211 and faucet 203 are attached to tap assembly 209. Depicted on the tap assembly is the low pressure gauge 112, designed to measure the pressure within the keg, and the high pressure gauge 114, designed to measure within the gas cylinder. The refrigerator keeps the beer cold so it will not produce excess foam when it is dispensed. The present invention may operate as shown, vertically, or with the keg laid sideways in the refrigerator and with an insulating barrier placed between the keg and the front of the refrigerator. This embodiment of the invention hides the keg and the dispensing systems so only flex line 211 and faucet 213 is visible. This provides a neat and convenient home draft beer dispenser that would keep the beer fresh; just a commercial system does in a bar.

Beer must be maintained above freezing and below 42° F. in order to maintain proper freshness and carbonation. The chart below gives the target $CO_2$ pressure to be set on the regulator for various temperatures to allow 6 weeks of perfectly carbonated beer. Beer is best stored and served below a 40° F. keg temperature.

Keg Temperature & Pressure Chart (for all 100% $CO_2$ Systems)

| Keg Temperature (° F.) | 35 | 37–38 | 38–39 | 40 | 41–42 | 43–44 |
|---|---|---|---|---|---|---|
| Internal Keg Pressure (pounds) | 10 | 11 | 12 | 13 | 14 | 15 |
| Minimum Applied Pressure (pounds) | 13 | 14 | 15 | 16 | 17 | 18 |
| Maximum Applied Pressure (pounds | 16 | 17 | 18 | 19 | 20 | 21 |

Depending on the chemical composition of the beer, different beer brands may require various gas pressure adjustments to prevent foaming and to maximize pouring ability. Now more than ever, there is an increased demand for foreign beers with chemical compositions that often vary greatly from region to region. In addition, the explosion of microbreweries in the United States has also altered the once nearly uniform composition of beers available in this country. Standard American lager beers for example are composed of higher water content than that of popular English and Irish beers. The percentage of water in the beers affects the viscosity, and therefore affects the length of time needed for a beer head to settle after pouring at a given pressure. It is therefore necessary to adjust the pressure for each individual type of beer to provide for optimal pouring effectiveness. For example, standard American lager beers are poured at a pressure of 10–15 p.s.i., while many of the European beers require that they be poured at a pressure of 5–7 p.s.i.

Although this specification discloses the best embodiment of the invention known to the inventor, it should not be read as limiting the invention. The invention should be limited only by the appended claims and their equivalents.

I claim:

1. A beer delivery system comprising;

a beer tap having a gas inlet, a beer outlet and a keg connection means for functionally attaching the beer tap to any standard commercially available beer keg;

an easily adjustable gas pressure regulator having a high pressure inlet, a low pressure outlet, and a pressure control means directly connected to and in fluid communication with said high pressure inlet and low pressure outlet for varying the gas pressure at said low pressure outlet; said low pressure outlet of said gas pressure regulator being rigidly connected to and in fluid communication with said gas inlet of said beer tap;

a high pressure gas cylinder rigidly connected to and in fluid communication with the high pressure inlet of said gas pressure regulator;

a check valve having an inlet and an outlet, said inlet of said check valve being rigidly connected to and in fluid communication with the low pressure outlet of said gas pressure regulator and the outlet of said check valve being rigidly attached to and in fluid communication with the gas inlet of said beer tap; and a Thomas valve between the outlet of said check valve and the gas inlet of said beer tap.

2. A beer delivery system as in claim 1 wherein the beer tap has a beer faucet connected to and in fluid communication with the beer outlet of said beer tap.

3. A beer delivery system as in claim 2 wherein a flex hose is connected to and in fluid communication with said beer outlet and said beer faucet.

* * * * *